US008228260B2

(12) United States Patent
Huffer et al.

(10) Patent No.: US 8,228,260 B2
(45) Date of Patent: Jul. 24, 2012

(54) STRUCTURE HAVING AN ANTENNA INCORPORATED THEREIN

(75) Inventors: Scott William Huffer, Hartsville, SC (US); Lawrence E. Renck, Hartsville, SC (US); David E. Rhodes, Hartsville, SC (US); Tony F. Rummage, Hartsville, SC (US)

(73) Assignee: Sonoco Development, Inc., Hartsville, SC (US)

( * ) Notice: Subject to any disclaimer, the term of this patent is extended or adjusted under 35 U.S.C. 154(b) by 531 days.

(21) Appl. No.: 12/437,797

(22) Filed: May 8, 2009

(65) Prior Publication Data

US 2010/0283709 A1 Nov. 11, 2010

(51) Int. Cl.
*H01Q 1/36* (2006.01)

(52) U.S. Cl. ..... 343/895

(58) Field of Classification Search ..... 343/895
See application file for complete search history.

(56) References Cited

U.S. PATENT DOCUMENTS

| | | | | |
|---|---|---|---|---|
| 2,583,745 | A * | 1/1952 | Miller | 343/727 |
| 3,430,543 | A | 3/1969 | Cunningham | |
| 3,683,393 | A * | 8/1972 | Self | 343/806 |
| 4,287,244 | A | 9/1981 | McMahon, Jr. et al. | |
| 5,198,831 | A | 3/1993 | Burrell et al. | |
| 5,896,113 | A * | 4/1999 | O'Neill, Jr. | 343/895 |
| 6,027,027 | A | 2/2000 | Smithgall | |
| 6,154,184 | A | 11/2000 | Endo et al. | |
| 6,394,385 | B1 | 5/2002 | Rhodes et al. | |
| 6,653,987 | B1 | 11/2003 | Lamensdorf et al. | |
| 6,667,092 | B1 | 12/2003 | Brollier et al. | |
| 6,916,393 | B2 | 7/2005 | Ohzuru et al. | |
| 7,038,587 | B2 | 5/2006 | Bellum et al. | |
| 7,102,518 | B2 | 9/2006 | Bellum et al. | |
| 7,112,356 | B2 | 9/2006 | Nomula et al. | |
| 7,151,979 | B2 | 12/2006 | Andersen et al. | |
| 2003/0016184 | A1 | 1/2003 | Kitching et al. | |
| 2004/0102870 | A1 | 5/2004 | Andersen et al. | |
| 2004/0200492 | A1 | 10/2004 | Brooks | |
| 2006/0036346 | A1 | 2/2006 | Andersen et al. | |
| 2006/0290511 | A1 | 12/2006 | Shanton | |
| 2006/0290513 | A1 | 12/2006 | Shanton | |
| 2007/0024518 | A1 | 2/2007 | Miyoshi et al. | |
| 2007/0193910 | A1 | 8/2007 | Ernst | |
| 2008/0048831 | A1 | 2/2008 | Tossavainen | |
| 2008/0174512 | A1 | 7/2008 | Leisten | |

FOREIGN PATENT DOCUMENTS

WO WO 2008/088099 A1 7/2008

OTHER PUBLICATIONS

European Search Report for Application No. EP 10 25 0830 dated Aug. 25, 2010.

* cited by examiner

*Primary Examiner* — Tho G Phan
(74) *Attorney, Agent, or Firm* — Alston & Bird LLP

(57) ABSTRACT

Structures having an antenna incorporated therein are provided. Each structure may comprise one or more strips of flexible sheet material wrapped about an axis and secured together. The antenna may comprise an electrically conductive material secured to one or more of the strips in a pattern forming a closed loop except for a break in the loop defining a plurality of contracts for connection to an electrical device, which may be an RFID chip. The antenna may comprise a pair of spaced tracks with a connection therebetween, which may take the form of an intersection of the tracks or a connector. The antenna may extend for a substantial portion of the axial length of the tubular structure and may also extend helically around the tubular structure. Methods of manufacturing structures are also provided.

29 Claims, 8 Drawing Sheets

STRUCTURE HAVING AN ANTENNA INCORPORATED THEREIN

BACKGROUND OF THE INVENTION

The present disclosure relates to "smart packaging" systems and methods, and more particularly to electronic detection devices, such as radio frequency identification ("RFID") devices and methods of using these devices in packaging and package tracking systems.

Monitoring the location and status of items is advantageous in many applications. For example, in manufacturing environments it is important to know the whereabouts of items in a factory, and to identify and document the coming and going of items from a warehouse or the like. Bar codes have traditionally been used to identify and track items. In particular, 1D bar codes are most common and are used to identify items at the grocery store, etc. More recently, 2D bar codes have been developed and provide substantially more information than 1D bar codes. Thus, 2D bar codes are used with shipping labels and other items where more information is typically needed to identify the item(s) associated with the bar code. However, 1D and 2D bar code systems are often not compatible with one another. A further drawback is that the bar code must be positioned on the exterior of the item so that it is readable by a scanner or the like in order to transfer the information associated with the bar code. There cannot be anything blocking the line of sight between the scanner and the bar code.

Another method for tracking an item and/or transferring information about an item is through a magnetic strip having pre-programmed coded information that is attached to an outer surface of an item. The information is read by passing the magnetic strip through a high-resolution magnetic reader to produce an electric field. While this technology does not require a clear line-of-sight between the reader and the strip for proper reading of the information, the distance at which the strip can be read is limited, and the system is limited to read-only. The magnetic strips are also prone to damage, which can be a problem for longer magnetic strips that contain more data.

Yet another way to track items is through the use of RFID. RFID has been used for some time in a variety of applications, from tracking garments to pallets to trucks. RFID may work on an inductive principle. In a passive RFID system, a reader generates a magnetic field at a predetermined frequency. When a RFID device, which usually can be categorized as either read-only or read/write, enters the magnetic field, a small electric current forms in the device's resonant circuit, which may include an antenna and a capacitor. This circuit provides power to the RFID device, which then modulates the magnetic field in order to transmit information that is pre-programmed on the device back to the reader at a predetermined frequency, such as 125 kHz (low frequency) or 13.56 MHz (high frequency). The reader then receives, demodulates, and decodes the signal transmission, and then sends the data onto a host computer associated with the system for further processing.

An active RFID system may operate in much the same way, but in an active system the RFID includes its own battery, allowing the device to transmit data and information at the touch of a button. For example, a remote control garage door opener may use an active RFID device that transmits a predetermined code to the receiver in order to raise and lower the garage door at the user's discretion.

BRIEF SUMMARY OF THE DISCLOSURE

In accordance with embodiments of the present disclosure, a structure having an antenna incorporated therein is provided. The structure may comprise one or more strips of flexible sheet material wrapped about an axis and secured together to form a tubular structure, and an antenna secured to one or more of the strips, the antenna comprising an electrically conductive material arranged on the strip in a pattern forming a closed loop except for a break in the loop defining a plurality of contacts for connection to an electrical device. The antenna may extend along a substantial portion of the axial length of the tubular structure, which may in particular be in a range of 25% to 100% of the axial length of the tubular structure. Additionally or alternatively, the antenna may extend helically along the tubular structure for more or less than one full revolution about the tubular structure.

The pattern forming the antenna may comprise two spaced tracks of the electrically conductive material and a closed connection therebetween, which can be either a connector extending between the two tracks, for example when the two tracks are parallel to one another, or an intersection of the two spaced tracks. Further, the antenna may be disposed between two adjacent strips of the flexible material. In some embodiments, the electrically conductive material may comprise a waste trim material.

In accordance with various other embodiments of the invention, methods of manufacturing a structure are provided. The methods may comprise securing an electrically conductive material to a strip of flexible sheet material in a pattern forming a closed loop except for a break in the loop defining a plurality of contacts for connection to an electrical device. The methods may further comprise wrapping the strip of flexible material about an axis to form a tubular structure such that the antenna extends along a substantial portion of the axial length of the tubular structure, which may in particular be in a range of 25% to 100% of the axial length of the tubular structure. Additionally or alternatively, the strip of flexible material may be wrapped such that the antenna extends helically along the tubular structure for more or less than one full revolution about the tubular structure.

The methods may further comprise securing two spaced tracks of the electrically conductive material to the strip and forming a closed connection therebetween, which can be formed by extending a connector between the two spaced tracks, for example when the two tracks are oriented such that they are parallel to one another. Alternatively, the step of forming the closed connection can comprise intersecting the two spaced tracks. The tubular structure may be cut at the connector in order to divide the tubular structure into two tubular structures each having an antenna. Further, the antenna may be disposed between two adjacent strips of the flexible material.

Also, some embodiments may further comprise the step of connecting an integrated circuit device to the contacts. This connecting step may be performed before or after the wrapping step. Further, the wrapping step may be performed before or after the securing step. Additionally, the securing step may be performed before or after the connecting step. Accordingly, the method steps may be performed in various orders.

BRIEF DESCRIPTION OF THE SEVERAL VIEWS OF THE DRAWING(S)

Having thus described the embodiments in general terms, reference will now be made to the accompanying drawings, which are not necessarily drawn to scale, and wherein:

DETAILED DESCRIPTION OF THE DRAWINGS

Tubular structures and method of making them now will be described more fully hereinafter with reference to the accompanying drawings, in which some but not all embodiments are shown. Indeed, the present development may take many different forms and should not be construed as limited to the embodiments set forth herein; rather, these embodiments are provided so that this disclosure will satisfy applicable legal requirements. Like numbers refer to like elements throughout.

Figure 1:
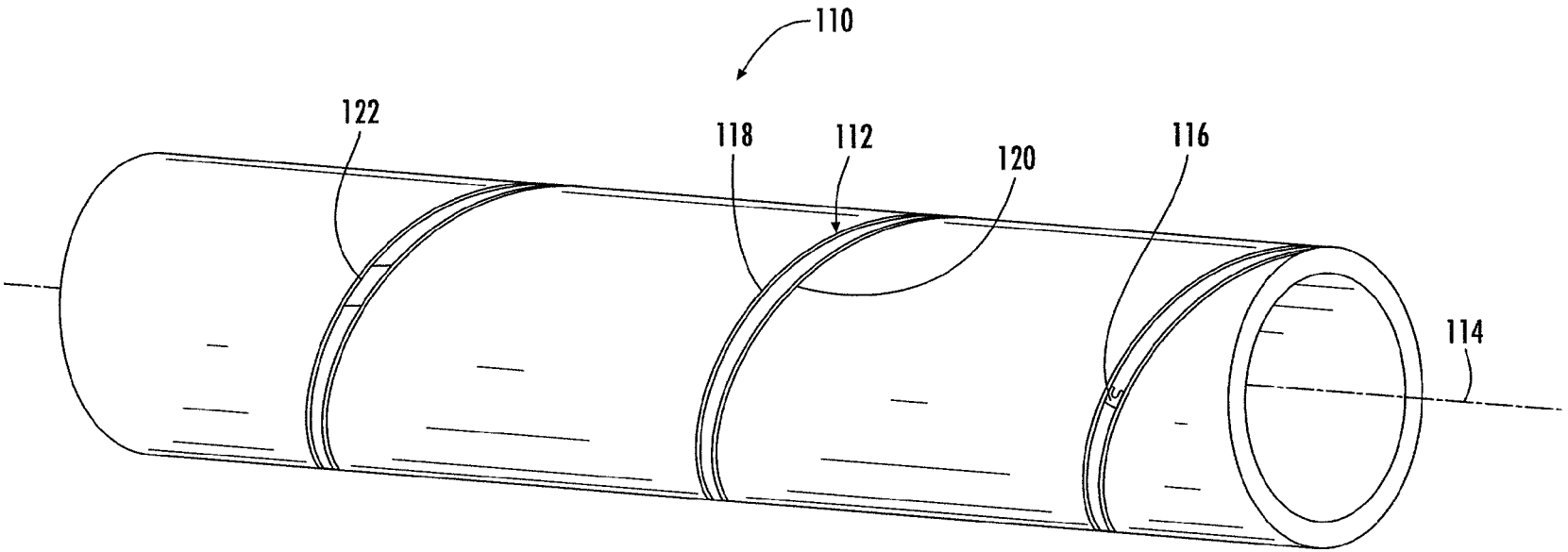
FIG. 1 is a side perspective view of a tubular structure according to one embodiment having a pair of helically extending spaced tracks of electrically conductive material secured thereto, with a connector and an electrical device secured therebetween.

Turning to the figures, FIG. 1 illustrates a tubular structure 110 having an antenna 112 incorporated therein. The tubular structure 110 may be used as a core for a roll of paper towels, toilet paper, wrapping paper, or as a support for roll goods such as textiles, paper, plastic, and other materials, in addition to other known uses of tubular structures as may be apparent to one skilled in the art. The antenna 112 is secured to the tubular structure 110 such that it helically extends along the tubular structure.

The antenna 112 comprises an electrically conductive material wrapped about an axis, which in this embodiment comprises the longitudinal axis 114 of the tubular structure 110. The electrically conductive material comprising the antenna 112 is arranged on the tubular structure 110 in a pattern forming a closed loop except for a break in the loop defining a plurality of contacts for connection to an electrical device 116. Electrical devices 116 can include a variety of different electrical apparatuses. In particular, any electrical device which can benefit from connection to an antenna could be attached to the contacts. For example, various types of integrated circuits could be attached, such as an RFID chip.

In this embodiment, the antenna 112 comprises two spaced tracks 118, 120 of the electrically conductive material. In particular, the two tracks 118, 120 are shown as being parallel to one another in this embodiment. There is also shown a connector 122 extending between the two spaced tracks 118, 120. This connector 122 helps form one portion of a closed loop except for the break defining the plurality of contacts for connection to the electrical device 116. The contacts in this embodiment comprise the two spaced tracks 118, 120. With the electrical device 116 attached, a closed loop is formed, which can act as a loop style antenna 112 for the electrical device 116.

Two features in particular of this embodiment of the tubular structure 110 are believed to provide beneficial results as compared to other structures having antennas, such as RFID tags having integrated coiled antennas. The first such feature is that the antenna 112 extends helically along the tubular structure 110. As a result of the helical configuration of the antenna 112, the antenna may have reception and transmission capabilities along a variety of different directions in relation to the longitudinal axis 114 of the tubular structure. In particular, in the embodiment shown in FIG. 1, the antenna 112 helically extends for more than one full revolution around the tubular structure. Hence, it is believed that reception and transmission of signals is facilitated in substantially all directions around the longitudinal axis 114 of the tubular structure 110. A second such feature is that the antenna 112 may extend for a substantial portion of the axial length of the tubular structure 110. In particular, the substantial portion may comprise twenty-five percent to one hundred percent of the axial length of the tubular structure 110. By also having the antenna 112 extend along a substantial portion of the tubular structure 110, reception and transmission ranges may further be increased, particularly when compared to smaller antennas and the coiled antennas commonly included in known RFID tags.

Figure 2:
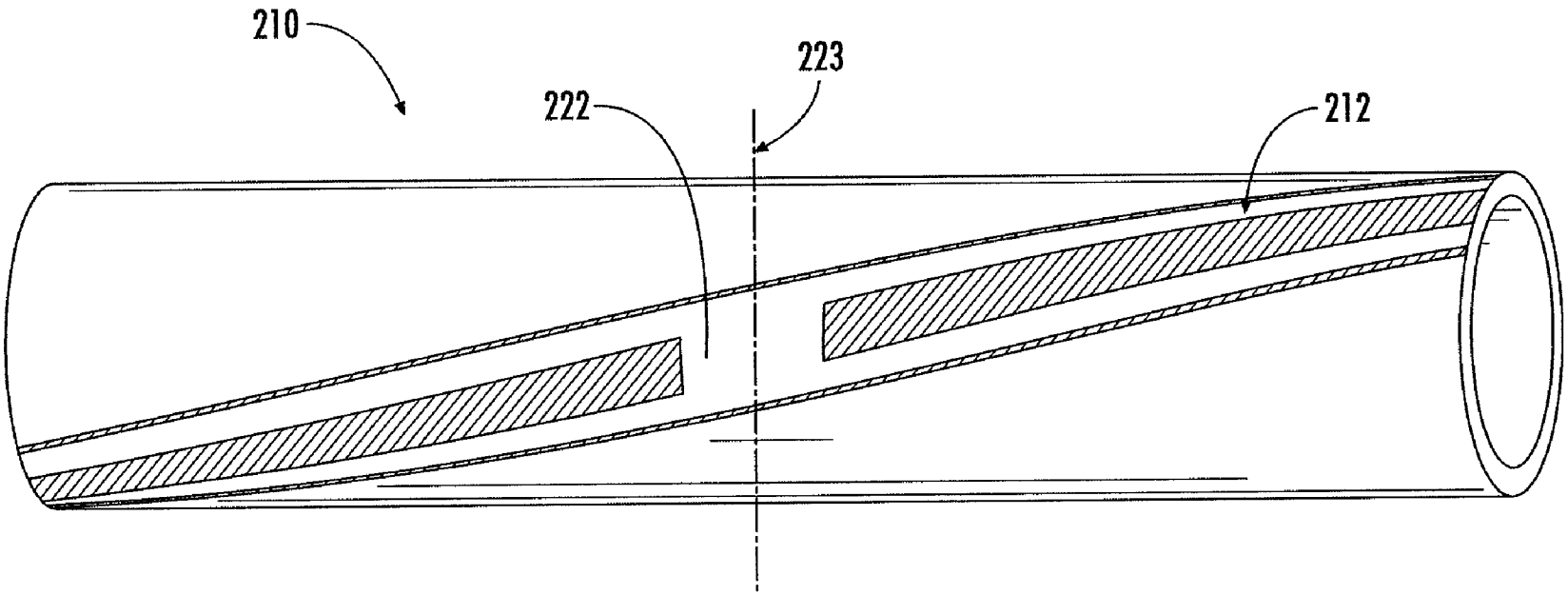
FIG. 2 is a side perspective view of a tubular structure according to another embodiment having a pair of helically extending spaced tracks of electrically conductive material secured thereto, with a wide connector secured therebetween.

FIG. 2 illustrates another embodiment of a tubular structure 210. Two features in particular differ from the embodiment shown in FIG. 1. First, the connector 222 is wide enough in the axial direction to facilitate cutting the tubular structure 210 through the connector so as to divide the tubular structure 210 into two separate tubular structures each having a portion of the connector. In particular, the cut line 223 indicates where a cut may be made. Second, the antenna 212 extends helically along the tubular structures 210, but does not complete a full revolution. This embodiment may be preferable in applications where a more directional antenna would be beneficial.

Figure 3:
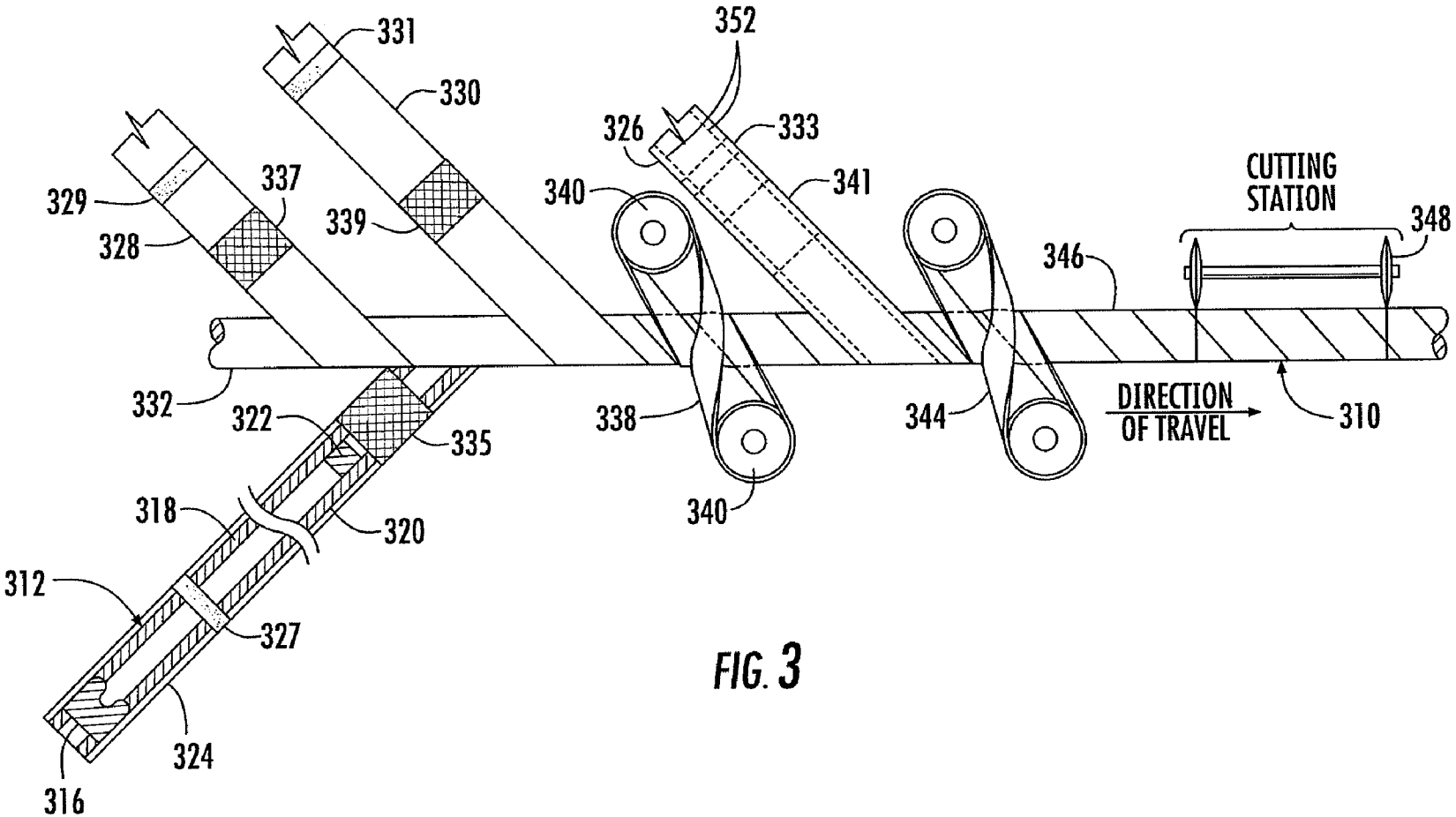
FIG. 3 is a plan view illustrating a method for making a multilayer tubular structure having an integrated antenna according to one embodiment.

FIG. 3 illustrates an embodiment of an apparatus and method of forming a tubular structure 310. In this embodiment, a shaping mandrel 332, which may be made out of steel or other suitably strong material, serves as a form about which the tubular structures 310 are formed. Thus, continuous strips of flexible sheet material 324, 326, 328, 330 are each advanced toward the shaping mandrel 332 at a suitable winding angle that is determined based on the diameter of the shaping mandrel and the width of the strips, so that the strips will be wound about the shaping mandrel in a helical fashion in such a way that the opposite edges of the successive helical turns of the strips either abut (which may be ideal) or have a slight gap (e.g. less than about 0.031 inches) therebetween. It is usually desired to avoid having the strip edges overlap because the overlap region creates a bump.

Each strip 324, 326, 328, 330 may have adhesive applied to at least one of its surfaces (the inner strip being free of adhesive on its surface that contacts the shaping mandrel 332) by a suitable adhesive applicator 327, 329, 331, 333 and then the adhesive may be warmed by a corresponding heater 335, 337, 339, 341. Thus, as each strip 324, 326, 328, 330 is wound onto a strip previously wound onto the shaping mandrel 332, the strips are adhered together by the adhesive, thereby forming a continuous multilayer tubular structure 346 on the shaping mandrel. The apparatus may also include one or more helical winding belts 338, 344 that engage the multilayer tubular structure 346 and advance it along the shaping mandrel 332 in a screw fashion, at a pitch corresponding to the winding angle. For example, in the embodiment shown, an inner strip 328, an intermediate strip 324, and a second intermediate strip 330 combine to form the continuous tubular structure 346 which may be advanced down the mandrel 332 by a first winding belt 338 that extends around a pair of opposed pulleys 340. The first winding belt 338 not only rotates and advances the continuous tubular structure 346, but also applies pressure to the individual strips 324, 328, 330 to ensure a secure bond therebetween. Downstream of the first winding belt 338, a continuous outer strip 326 may be advanced toward the mandrel 332. The continuous tubular structure 346 may then be advanced down the mandrel 332 by a second winding belt 344 after the addition of the outer strip 326. The second winding belt 344 also rotates and advances the continuous tubular structure 346 and applies pressure to the strips 324, 326, 328, 330 to ensure a secure bond between the strips. After the multiple strips 324, 326, 328, 330 have been secured together on the mandrel 332 to form the continuous tubular structure 346, the continuous tubular structure is scored or cut by a cutting station 348 to form individual tubular structures 310.

With regard to the particular features of the strips, the intermediate strip of flexible sheet material 324 is depicted as having an antenna 312 formed by a pair of tracks 318, 320 of electrically conductive material secured thereon and may also have a connector 322 and electrical device 316 secured thereto. Thus, in the embodiment of FIG. 3, as the strips of flexible material are wrapped one upon another about the axis, the antenna is disposed between the intermediate strip of flexible sheet material 324 and the second intermediate strip 330. In such an embodiment, the antenna may be protected by being sandwiched between the two strips 324, 330.

Referring back to the cutting step, the cutting is preferably performed at regular intervals such that the electrical device 316 (if applicable) is near one of the resulting ends but spaced inwardly therefrom so as to create a desired length of antenna 312 without damaging the electrical device. Further, as discussed above, the cut may be through a connector 322, such as a wide connector (see FIG. 2) so as to form connectors on the ends of two separate tubular structures 310. After the tubular structure 310 is cut, it is removed from the mandrel 332.

While spiral or helical winding has been discussed herein, the multilayer tubular structures of the present invention can be formed by convolute winding, linear draw, or the like, so as to produce tubes, cores, composite cans, convolute tubes, protective packaging, and the like. Also, in various alternative embodiments, the electrical device, electrically conductive material, and/or the connector may be placed on different strips, as may be envisioned by one of ordinary skill in the art, so long as they ultimately complete a circuit, such as is shown in the embodiments of FIGS. 1 and 2.

In various embodiments, the strips may have electrically conductive material, connectors, and/or electrical devices secured thereto prior to wrapping around the mandrel. However, in other embodiments, one or more of these elements may be secured to an outermost or innermost one of the strips after the strip is wrapped to form the tubular structure. Further, alternate embodiments of tubular structures may be formed from a single strip of flexible sheet material. Additionally, alternate embodiments may have electrically conductive material, a connector, and/or an electrical device on either the inner or outer surfaces of any strip of flexible sheet material forming the tubular structure. For example, tracks of electrically conductive material 352 may be placed on the outside of outer strip 326 such that they form part of the outer surface of a tubular structure. Such an embodiment may facilitate adding an electrical device and/or connector at a later point in time.

Figure 4:
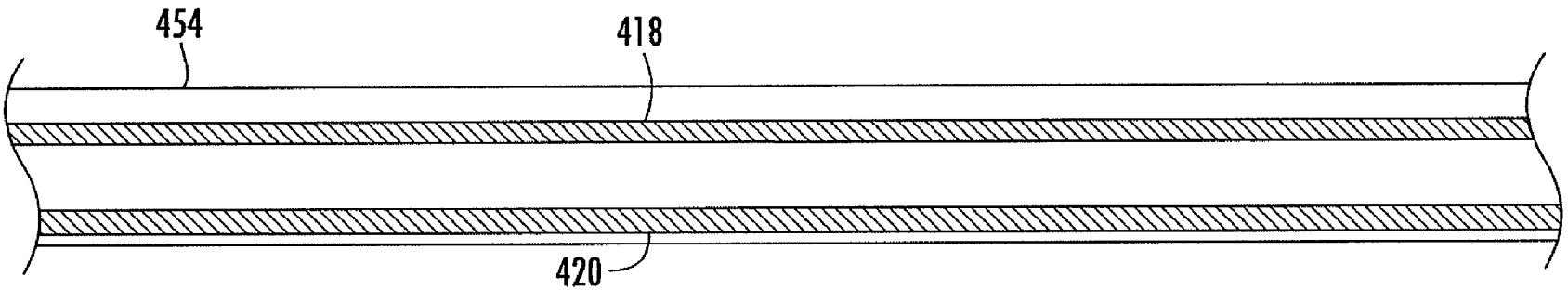
FIG. 4 depicts a strip of flexible sheet material having two spaced tracks of electrically conductive material secured thereto according to one embodiment.

With further regard to each of the strips of flexible sheet material, various embodiments are possible. For instance, as shown in FIG. 4, an example strip of flexible sheet material 454 may have electrically conductive material secured thereto prior to it being wound to form a tubular structure. Further, the electrically conductive material may be arranged in two tracks 418, 420, which may be parallel to one another. The electrically conductive material may take a variety of different forms in various embodiments. For instance, the electrically conductive material may comprise a conductive ink. Alternatively, the electrically conductive material may comprise waste trim such as scrap edge portions of aluminum foil or the like. In other embodiments, other types of metallic flexible materials may be used such as metal wire or other similar materials, as would be apparent to one skilled in the art.

Figure 5:
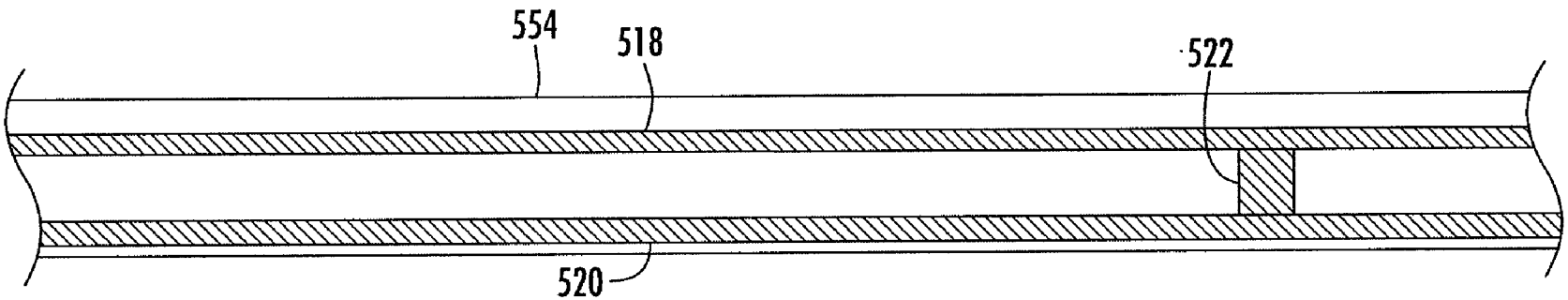
FIG. 5 depicts a strip of flexible sheet material having two spaced tracks of electrically conductive material secured thereto and a connector secured therebetween.

FIG. 5 illustrates an embodiment of the strip of flexible sheet material 554 having spaced parallel tracks 518, 520 of electrically conductive material and further having a connector 522 forming a closed electrical connection therebetween. As is the case in all embodiments using a connector, the connector may comprise a variety of different means. For instance, the connector may comprise conductive ink, a conductive hot melt adhesive, a conductive adhesive pad, conductive tape, a staple, or any type of conventional connection. Further, as previously described in relation to FIG. 2, the connector may comprise a wide connection area. Accordingly, in such embodiments, the tubular structure may be cut through the connector in order to create connectors on the ends of two separate tubes.

Figure 6:
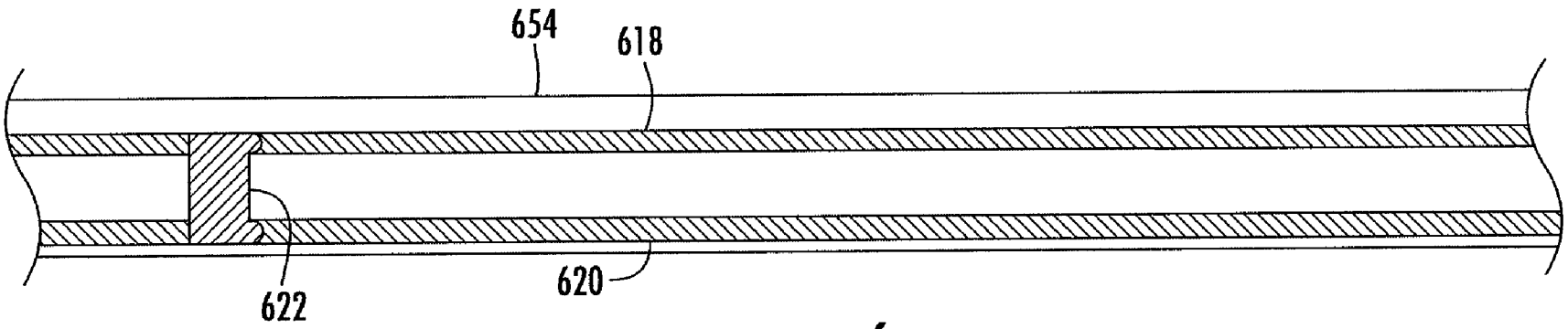
FIG. 6 depicts a strip of flexible sheet material having two spaced tracks of electrically conductive material secured thereto and an electrical device secured therebetween.

FIG. 6 illustrates an embodiment of a strip of flexible sheet material 654 having spaced parallel tracks 618, 620 of electrically conductive material and further having an electrical device 622 connected thereto. As may be seen, the tracks 618, 620 of conductive material may actually extend beyond the electrical device 622 in both directions along the strip of flexible sheet material 654. Thus, in this particular embodiment, the spaced tracks 618, 620 of electrically conductive material define two continuous contacts for connection to the electrical device 622. In alternate embodiments, tracks of electrically conductive material may terminate at a certain point along the strip of flexible sheet material. In such embodiments the ends of the tracks may act as contacts for attachment to an electrical device. Various other embodiments may be apparent to one having ordinary skill in the art. The only requirement in this regard is that there be a plurality of contacts for connection to the electrical device such that a closed loop circuit (extending between the electrical device and the connector) may be formed.

Figure 7:
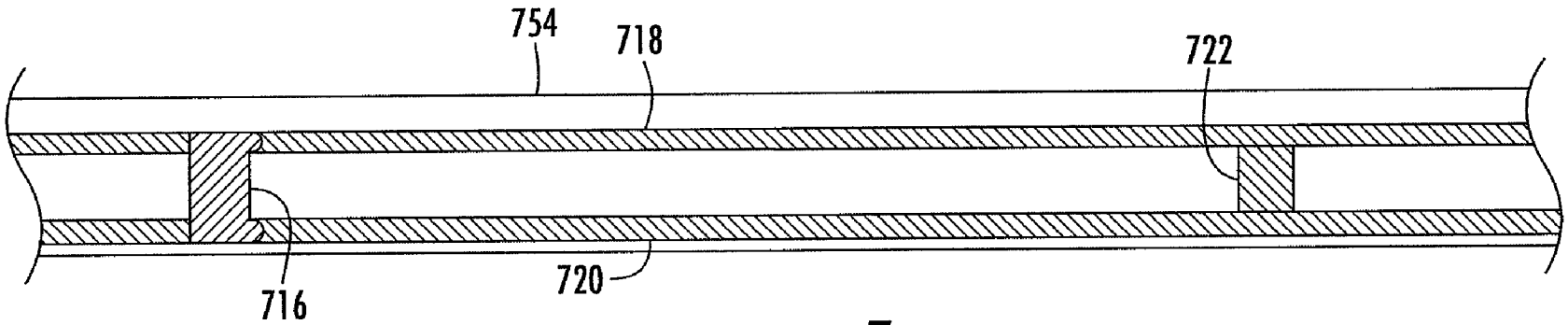
FIG. 7 depicts a strip of flexible sheet material having two spaced tracks of electrically conductive material secured thereto and a connector and an electrical device secured therebetween.

Accordingly, FIG. 7 depicts an embodiment having a completed closed circuit on a strip of flexible sheet material 754. The closed circuit comprises electrically conductive material arranged on the strip of flexible sheet material 754 in a pattern which takes the shape of a pair of tracks 718, 720 in this embodiment. At one position along the tracks 718, 720, this embodiment has a connection formed by a connector 722 extending between the two tracks. At a second position along the tracks 718, 720, displaced from the first position, an electrical device 716 is connected to the two tracks, to form a completed closed circuit.

Figure 8:
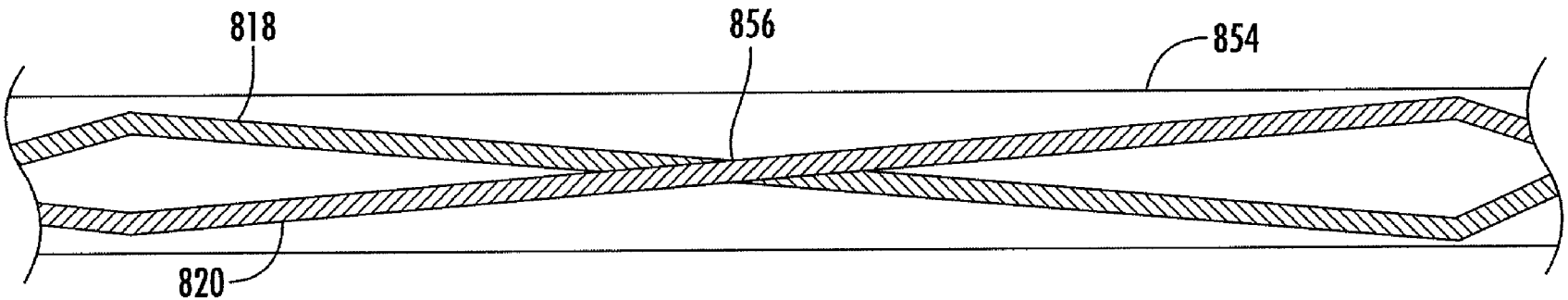
FIG. 8 depicts a strip of flexible sheet material having two tracks of electrically conductive material secured thereto and arranged such that they intersect to make the connection between them.

The above embodiments have generally been described as having a connection between two tracks of the electrically conductive material comprising a separate connector. However, the connection may also take the form of an intersection between the two tracks of electrically conductive material. In particular, as shown in FIG. 8, both of the tracks 818, 820 of electrically conductive material may form angles with respect to the longitudinal axis of the strip of flexible material 854 and still form a closed connection comprising an intersection 856 of the two tracks. In alternate embodiments, a first track of the electrically conductive material may extend in a direction substantially parallel with the longitudinal axis of the strip of flexible sheet material, while the second track of the electrically conductive material forms an angle with the first track such that they intersect. Other similar embodiments may be envisioned by one having ordinary skill in the art. For instance, one or both of the tracks may form a sinusoidal pattern along the strip of flexible sheet material such that the two tracks intersect.

As described above, the electrically conductive material, connectors, and electrical devices may be secured to a strip making up the tubular structure before or after the wrapping of the strip. In particular, it may be possible to preprint conductive ink onto a strip of flexible sheet material prior to winding the tubular structure, or the conductive ink may be printed onto a strip of flexible sheet material in an inline manner just prior to the wrapping step. Additionally, electrically conductive material may be secured to a strip of the flexible sheet material (particularly an outermost or innermost strip) after the strip has been wrapped to form the tubular structure. Similar methods may be used for attachment of the connectors and electrical devices. For example, the wrapping of the strips of flexible sheet material may occur before or after the securing of the antenna to a strip, and before or after the connecting of an integrated circuit device to the contacts occurs. Further, the securing of the antenna may occur before or after the connecting of the integrated circuit device to the contacts. Accordingly, the timing of completion of the electrical circuit formed by the conductive material, connector, and electrical device can be varied to allow for numerous manufacturing methods.

Many modifications and other embodiments will come to mind to one skilled in the art to which these embodiments pertain having the benefit of the teachings presented in the foregoing descriptions and the associated drawings. Therefore, it is to be understood that modifications and other embodiments are intended to be included within the scope of the appended claims. Although specific terms are employed herein, they are used in a generic and descriptive sense only and not for purposes of limitation.

That which is claimed:

1. A structure having an antenna incorporated therein, comprising:

one or more strips of flexible sheet material helically wrapped about an axis and secured together to form a tubular structure; and an antenna secured to one of the strips, the antenna comprising two spaced tracks of an electrically conductive material extending lengthwise along the strip and a closed connection therebetween, forming a closed loop except for a break in the loop defining a plurality of contacts for connection to an electrical device, wherein the antenna helically extends along a substantial portion of the axial length of the tubular structure.

2. The structure of claim 1, wherein the closed connection comprises a connector extending between the two spaced tracks.

3. The structure of claim 2, wherein the two spaced tracks are parallel to one another.

4. The structure of claim 1, wherein the closed connection comprises an intersection of the two spaced tracks.

5. The structure of claim 1, wherein the antenna helically extends for at least one full revolution about the tubular structure.

6. The structure of claim 1, wherein the strips are wrapped one upon another about the axis, and the antenna is disposed between two adjacent strips.

7. The structure of claim 1, wherein the substantial portion is in a range of 25% to 100% of the axial length.

8. The structure of claim 1, wherein the electrically conductive material comprises a waste trim.

9. A structure having an antenna incorporated therein, comprising:

one or more strips of flexible sheet material wrapped about an axis and secured together to form a tubular structure;

an antenna secured to one of the strips, the antenna comprising an electrically conductive material arranged on the strip in a pattern forming a closed loop except for a break in the loop defining a plurality of contacts for connection to an electrical device, wherein the antenna extends helically along the tubular structure; and an integrated circuit device connected to the contacts.

10. The structure of claim 9, wherein the pattern comprises two spaced tracks of the electrically conductive material and a closed connection therebetween.

11. The structure of claim 10, wherein the closed connection comprises a connector extending between the two spaced tracks.

12. The structure of claim 11, wherein the two spaced tracks are parallel to one another.

13. The structure of claim 10, wherein the closed connection comprises an intersection of the two spaced tracks.

14. The structure of claim 9, wherein the antenna helically extends for at least one full revolution about the tubular structure.

15. The structure of claim 9, wherein the strips are wrapped one upon another about the axis, and the antenna is disposed between two adjacent strips.

16. The structure of claim 9, wherein the electrically conductive material comprises a waste trim.

17. A method of manufacturing a structure, comprising:

securing two spaced tracks of an electrically conductive material to a strip of flexible sheet material and forming a closed connection between the tracks on the strip, the tracks extending lengthwise along the strip, the tracks and closed connection forming an antenna in the form of a closed loop except for a break in the loop defining a plurality of contacts for connection to an electrical device; and helically wrapping the strip of flexible material about an axis to form a tubular structure such that the antenna helically extends along a substantial portion of an axial length of the tubular structure.

18. The method of claim 17, wherein the step of forming a closed connection comprises extending a connector between the two spaced tracks of the electrically conductive material.

19. The method of claim 18, further comprising cutting the tubular structure at the connector to form a second tubular structure.

20. The method of claim 17, wherein the securing step comprises orienting the two spaced tracks of the electrically conductive material such that the two spaced tracks are parallel to one another.

21. The method of claim 17, wherein the securing step comprises intersecting the two spaced tracks of the electrically conductive material to form the closed connection.

22. The method of claim 17, wherein the securing step comprises configuring the antenna such that the antenna extends along 25% to 100% of the axial length.

23. The method of claim 17, further comprising connecting an integrated circuit device to the contacts.

24. The method of claim 23, wherein the connecting step is performed after the wrapping step.

25. The method of claim 23, wherein the connecting step is performed before the wrapping step.

26. The method of claim 23, wherein the wrapping step is performed after the securing step.

27. The method of claim 23, wherein the wrapping step is performed before the securing step.

28. The method of claim 23, wherein the securing step is performed after the connecting step.

29. The method of claim 23, wherein the securing step is performed before the connecting step.

* * * * *